United States Patent [19]

Kellner

[11] Patent Number: 4,938,379

[45] Date of Patent: Jul. 3, 1990

[54] COVER FOR A BEVERAGE CAN

[76] Inventor: Louis W. Kellner, 901 Hiawatha Dr., Elgin, Ill. 60120

[21] Appl. No.: 288,958

[22] Filed: Dec. 23, 1988

[51] Int. Cl.[5] ..... B65D 51/16

[52] U.S. Cl. ..... 220/370; 220/367; 220/90.2; 220/90.4

[58] Field of Search ..... 220/90.2, 90.4, 90.6, 220/253, 367, 369, 370, 371, 372

[56] References Cited

U.S. PATENT DOCUMENTS

| | | | |
|---|---|---|---|
| 3,905,512 | 9/1975 | Albert et al. | 220/90.4 |
| 3,938,695 | 2/1976 | Ruff | 220/90.4 |
| 4,098,439 | 7/1978 | Blow, Jr. | 220/90.2 X |
| 4,366,914 | 1/1983 | Ingram | 220/90.4 X |
| 4,412,629 | 11/1983 | Dart et al. | 220/90.4 |
| 4,537,326 | 8/1985 | Morehead | 220/269 |
| 4,619,372 | 10/1986 | McFarland | 220/90.4 |

FOREIGN PATENT DOCUMENTS

| | | | |
|---|---|---|---|
| 2738938 | 3/1979 | Fed. Rep. of Germany | 220/370 |

*Primary Examiner*—Stephen Marcus
*Assistant Examiner*—Nova Stucker
*Attorney, Agent, or Firm*—Charles F. Meroni, Jr.

[57] ABSTRACT

The protective one piece circular dish shaped synthetic plastic beverage can top cover having an upstanding integral loop-shaped radially outer rim for nested engagement with a raised circular can edge of a beverage can. The loop-shaped outer cover rim defines an axially inwardly opening annular groove for receiving a raised circular edge of the beverage can when the cover is mounted upon an upper open end of a beverage can. The cover has a dish shaped depressed area that has a meshed area alignable with the can opening in an upper end of the beverage can to allow beverage fluids to flow from the beverage can through the meshed area of the cover. The cover and the meshed area are cooperable with the loop-shaped outer cover rim when mounted upon the beverage can to prevent bees and the like from entering the can opening in the top of the beverage can.

20 Claims, 2 Drawing Sheets

COVER FOR A BEVERAGE CAN

FIELD OF THE INVENTION:

The present invention relates generally to a protective one piece circular drop center synthetic plastic beverage can top cover for mounted attachment upon an upper open end of a liquid container in removal assembly therewith.

BACKGROUND OF THE INVENTION:

In the past, there has been a continuing need for some sort of a protective device to prohibit bees and the like from entering into an upper open end of a beverage container so as to prevent a bee from entering into the mouth of an unsuspecting person who may be drinking from the container. In the past, serious injuries have occurred where bees have gotten into the open end of a beverage can and where the drinker has been stung on his or her facial tissues or tongue resulting in serious injury and death on occasion.

To this end, the state of the art has developed to the point where at least one U.S. patent has issued which concerns itself with the overall problem and attention is directed to U.S. Pat. No. 4,537,326 issued to Clyde D. Morehead on Aug. 27, 1985 and which is entitled: "Protector for Drink Opening". This patent specifically concerns itself with a small sized protector identified at 20 in the patent that is mounted by the can manufacturer upon the can and secured to the can by a rivet. A number of different embodiments are shown in this patent and all of them possess essentially this same riveted feature insofar as the element 20 is concerned. The element 20 constitutes a small protector which is only slightly larger than the can opening and is adapted to overly only the opening.

Other devices are also disclosed in the prior art but none of them are specifically concerned with providing protection against bees entering an opening in a can. Other issued U.S. patents known by the inventor are listed below, as follows:

| INVENTOR'S NAME | TITLE OF PATENT | U.S. Pat. No. |
|---|---|---|
| Joseph Leach | Improvement in Covers for and Coffee Cups | 110,148 |
| L. A. Robbins | Combined Bottle Cap and Strainer | 1,198,959 |
| P. Davis | Vent Opening | 3,387,765 |
| Allen Zoellick | Covers for Drinking Containers | 4,081,103 |
| Bush et al. | Child Resistant Dispensing Closure | 4,284,200 |
| Joseph McFarland | Cap for Hot Beverage Cup | 4,619,372 |
| Hickman | Two-Flap Closure | 4,693,399 |

The protective one piece circular synthetic plastic beverage can top cover that is the subject of my invention is a removable cover that can be re-used. The cover is essentially adapted to be secured to the rim of a beverage can in overlying protective assembly with respect to the open end of the beverage can and the cover has a depressed meshed area adapted to be closely positioned relative to a key hole opening in the can for beverage to flow through the meshed area in a carefully controlled manner to minimize spillage of the beverage.

The cover of my invention can be sold in the after market rather than be manufactured as an integral part of the can by a can manufacturer. Thus, the user would have the advantageous option as to whether he may wish to use the protective cover or not use it. This option given to the user enables the user to use the cover when the bees and the like are more of a problem and to avoid using the cover in other seasons of the year. It is a further important element of my invention to provide a protective cover that can be optionally used and attached with a beverage can by the user rather than to have a can manufacturer provide a protector on all cans being manufactured whether or not the bees are a problem to the ultimate consumer that purchases this beverage can. Thus the costs of providing the cover to a can manufacturer can be reduced by only selectively using my ew cover for the can rather than having a small shield or cover permanently attached to the can.

The protective cover that is here disclosed has other important features which will be further described hereafter.

SUMMARY OF THE INVENTION

In accordance with the present invention a protective one piece circular dish shaped synthetic plastic beverage can top cover 10 having an upstanding integral loop-shaped radially outer rim for nested engagement with a raised circular can edge of a beverage can, the loop-shaped outer cover rim defining an axially inwardly opening annular groove for receiving a raised circular edge of the beverage can when the cover is mounted upon an upper open end of a beverage can, the cover having a depressed area that has a meshed area positioned alignable with the can opening in an open upper end of the beverage can to allow beverage fluids to flow from the beverage can through the meshed area of the cover, the cover and the meshed area being cooperable with the loop-shaped outer cover rim when mounted upon the beverage can to prevent bees and the like from entering the can opening in the top of the beverage can.

As a further feature of my protective cover, it is provided with a U-shaped tab which is mounted integrally with a radially outer end of the loop-shaped outer cover rim for being positioned exterially of the beverage can to enable the user to manually grasp the tab and pull the tab and the cover upwardly when the beverage can is resting on its bottom.

It is feature a of my invention that the protective cover is provided with a U-shaped tab being mounted integrally with a radially outer end of the loop-shaped outer cover rim for being positioned exterially of the beverage can to enable the user to manually grasp the tab and pull the tab and the cover upwardly when the beverage can is resting on its bottom.

It is yet another feature of my invention that the protective cover is provided with a U-shaped tab where the tab projects radially outwardly generally at right angles to axial axis through a center of the cover.

Yet another new feature of my protective cover concerns the meshed area being comprised of a series of small holes each of which is 0.062" square.

Other new features of my protective cover relate to the provision of holes in the meshed area which are at least 25 in number.

Still another feature of my protective cover concerns the provision of a vent hole being located in the cover radially inwardly of the outer cover rim.

Yet another feature of my protective cover concerns its depressed area being of an arched shape and with a remaining center area being raised relative to the depressed area to provide a downwardly opening cavity for receiving a can punch key.

According to still further features of my invention I have provided a beverage can assembly which includes a beverage can having a raised circular can edge, and a can key for punching a can opening in the cover, the improvement of a protective one piece circular dish shaped synthetic plastic beverage can top cover having an upstanding integral loop-shaped radially outer rim for nested engagement with a raised circular can edge of a beverage can, the loop-shaped outer cover rim defining an axially inwardly opening annular groove for receiving the raised circular edge of the beverage can when the cover is mounted upon an upper open end of a beverage can, the cover having a depressed area that has a meshed area alignable with the can opening in an open upper end of the beverage can to allow beverage fluids to flow from the beverage can through the meshed area of the cover, the cover and the meshed area being cooperable with the loop-shaped outer cover rim when mounted upon the beverage can to prevent bees and the like from entering the can opening in the top of the beverage can.

According to yet still further features of my invention I have provided a protective one piece circular dish shaped synthetic plastic can top cover sized for mounted press-on pull-off retained engagement with a top end of a beverage can and having an upstanding integral loop-shaped radially outer rim for nested engagement with a raised circular can edge of a beverage can, the loop-shaped outer cover rim defining an axially inwardly opening annual groove for receiving a raised circular edge of the beverage can when the cover is mounted upon an upper open end of a beverage can, the cover having a depressed area that has a meshed area lying in a plane beneath the radially outer cover rim for close disposition to a key hole opening in a depressed area of a top of a beverage can, the meshed area being alignable with the can opening at an open upper end of the beverage can to allow beverage fluids to flow from the beverage can through the meshed area of the cover, the cover and its meshed area being cooperable with the loop-shaped outer cover rim when mounted upon the beverage can to prevent bees and the like for entering the can opening in the top of the beverage can.

Other features of my invention concern my cover having its loop-shaped radially outer rim and the depressed area sharing a common wall portion linking them together, the common wall portion extending in a radially and axially inclined direction and thus enabling a radially outer surface of the common wall portion to act as a lead in to aid in guiding a rim of a beverage can to be guided into engaged relation in the axially inwardly opening groove, the depressed area being of an arcuate shape defining a fluid cup for beverage and with a remaining center area being raised relative to the depressed area to provide a downwardly opening cavity for housing a can punch key when the cover is assembled with a beverage can. Other features and advantages of the present invention are stated in or apparent from a detailed description of presently embodiments of the invention found herein below.

DETAILED DESCRIPTION OF THE PREFERRED EMBODIMENTS

Figure 1:
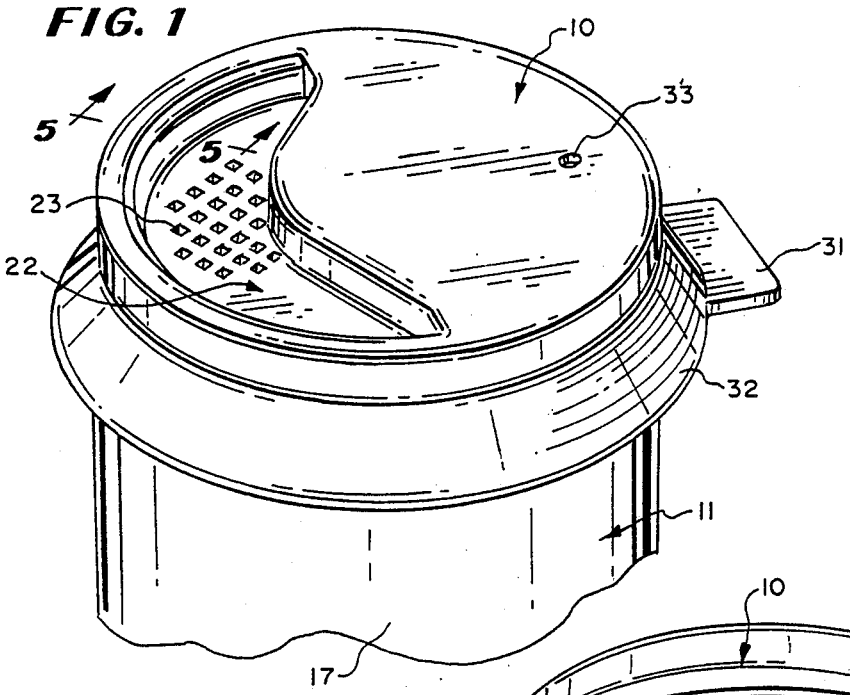
FIG. 1 is an enlarged fragmentary prospective view of a beverage can with my new protective one piece circular synthetic dish shaped plastic beverage can and top cover mounted thereon.

The reference numeral 10 indicates my new protective one piece circular dish shaped synthetic plastic beverage can top cover which is illustrated in all of the figures of the patent drawings. As it is shown in the drawings, the cover is dished shape and is adapted to be mounted over the top end of a beverage can 11 in removable assembly therewith.

The beverage can 11 is of a conventional type now commonly available in the marketplace in the soft drink industry. This beverage can 11 has a key 12 that is secured in riveted assembly with the beverage can. Mounted adjacent to the key 12 is a key hole shaped can opening 13. This opening 13 can be created by lifting one end of the key 12 to cause it to exert leverage at its opposite end against the can top to punch out the can top to create the can opening 13 all in a conventional manner. In addition, the can 11 has an inwardly flaired upper neck 14 positioned beneath a can top 15 which is located at the area of the tab 13. The juncture of the inwardly flaired upper neck 14 with the can top 15 constitutes an upper rolled can edge 16 which secures the flaired upper neck 14 with the can top 15. It will be further observed that the can top 15 lies in a horizontal plane beneath the upper rolled can edge 16 so that the can is of a drop center type whereby the liquid key hole shaped can opening 13 lies in a plane beneath the upper rolled can edge 16.

My protective one piece dish shaped synthetic plastic beverage can top cover 10 has been uniquely configurated and constructed so that it can not only operate and function to positively inhibit bees and the like from gaining entrance into the open end of the can at 13 but it is also constructed so that it can be readily and easily assembled and disassembled with the can and in such a way that a meshed 18 can be located in close proximity to the can opening 13 well below an annular loop-shaped raised outer cover rim 20 all as will be described in further detail and which structural relationships embody important features of my invention.

The annular loop-shaped outer cover rim 20 defines an axially inwardly opening annular groove 21 for receiving the raised circular beaded outer edge 16 of the can 11. The cover further has a dish shaped depressed area 22 which when viewed from the top has an arched or arcuate configuration. The depressed area 22 has a meshed area 23 at its bottom which is alignable with the can opening 13 in the open upper end of the beverage can to allow beverage fluids to flow from the beverage can through the meshed area 23 of the cover 10. The cover 10 and the meshed area 23 are cooperable with the loop-shaped outer cover rim 20 when mounted upon the beverage can to prevent bees from entering the can opening 13 in the top of the beverage can. In the illustrated embodiment of my invention, the meshed area 23 is comprised of a series of small holes 24 which are each about 0.062" square. The holes in the meshed area are at least 25 in number so that the liquid in the can 11 can really flow through the meshed area and its holes in the cover 10. By providing a dish shaped depressed area 22, this depressed area cooperates to localize the fluid that emerges from the can opening 13 when the can is tipped so that the fluid can be localized in a controlled manner in the dish shaped depressed area 22 to minimize spillage and to control the beverage fluid so that there will be less tendency for the beverage fluid to spill as it is being poured into the mouth of the beverage drinker. When the can is then put down onto a surface after it has been tipped, then any fluid in the depressed area 22 will tend to flow back through the can opening into the beverage can 11.

In order to insure that there will not be any spillage of beverage fluid, the cover 10 and its loop-shaped radially outer rim is configurated for snug nested engagement with the raised circular can edge 16 of the can 11.

Figure 4:
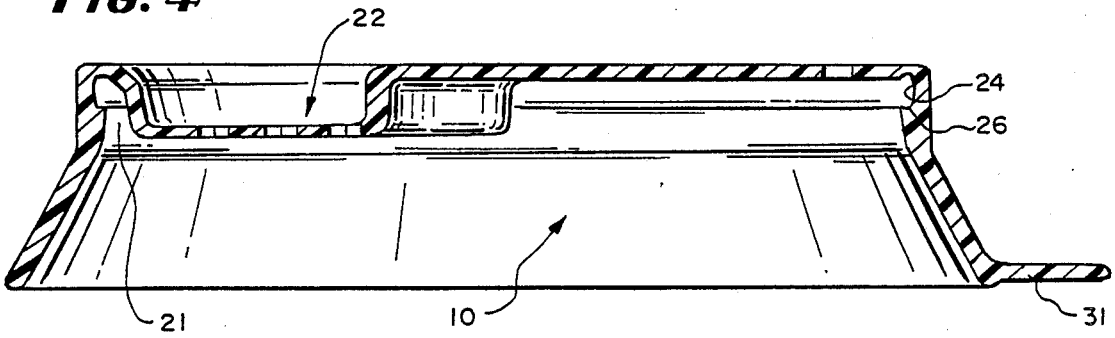
FIG. 4 is a vertical section taken on the line 4—4 in FIG. 3 looking in the direction indicated by the arrows as seen in FIG. 5.
Figure 5:
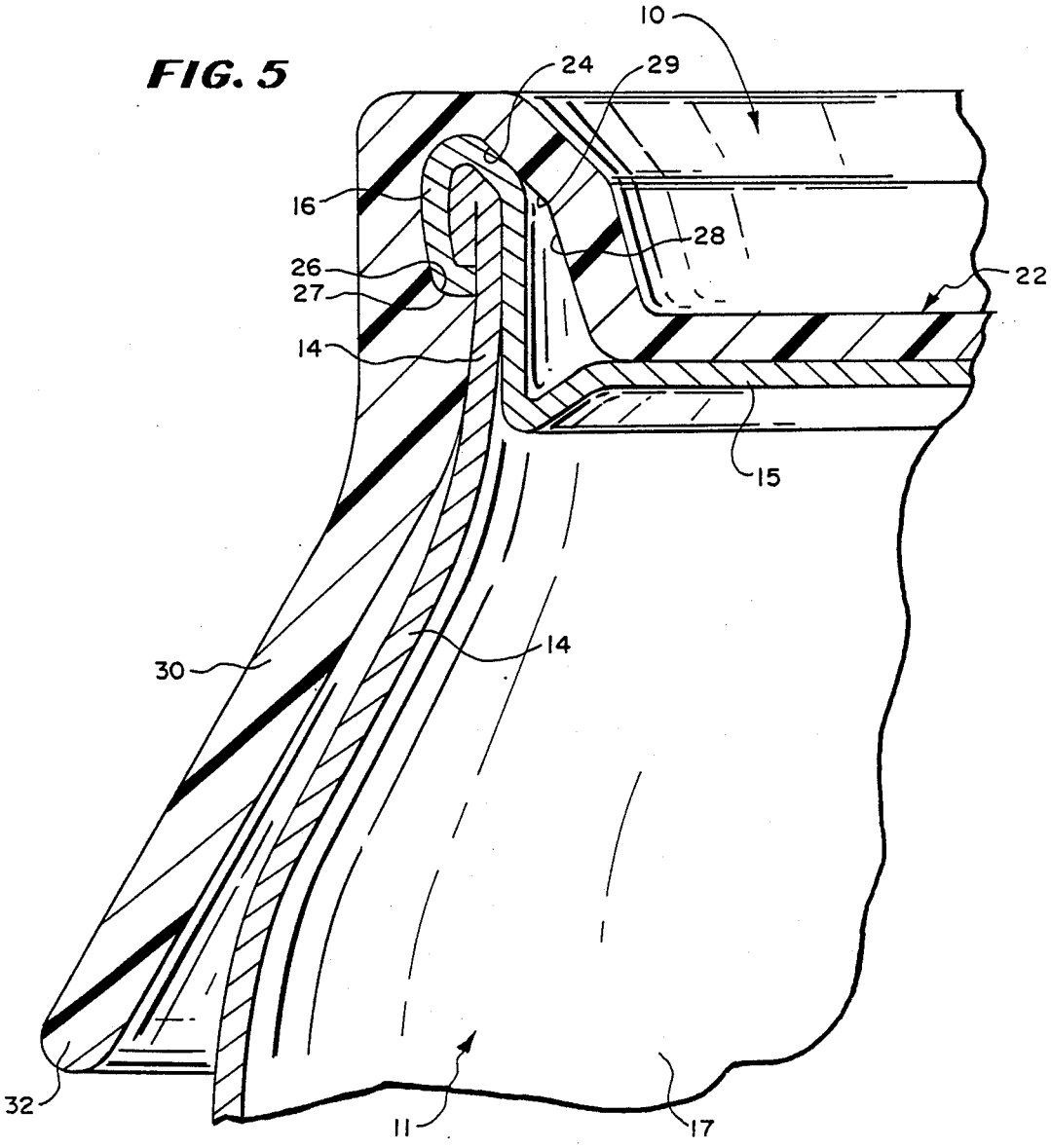
FIG. 5 is an enlarged vertical section taken on the line 5—5 looking in the direction indicated by the arrows as seen in FIG. 1.

The axially inwardly opening annular groove 24 (FIGS. 4 and 5) in the cover is generally of a goose-shaped configuration and is defined in part by an enlarged bead like shaped groove portion 25 and further by an annular groove shoulder 26. The grooved portion 25 is adapted to receive the rolled beaded can edge 16 and the groove shoulder 26 is adapted to engage beneath a downwardly facing beaded can shoulder 27 (FIG. 5) in snug nested engagement with virtually the entire surface of the rolled beaded can edge 16.

In order to assist in the assembly of the cover 10 on the can 11 without interference from the dish shaped depressed area 22, the area 22 has a radially and axially inwardly extending annular or circular surface area 28 (FIG. 5) that extends radially and axially inwardly of the annular groove 21 and the groove 21 is further defined by an offset lead in circular edge 29 that separates the groove 21 from the surface area 28.

Figure 2:
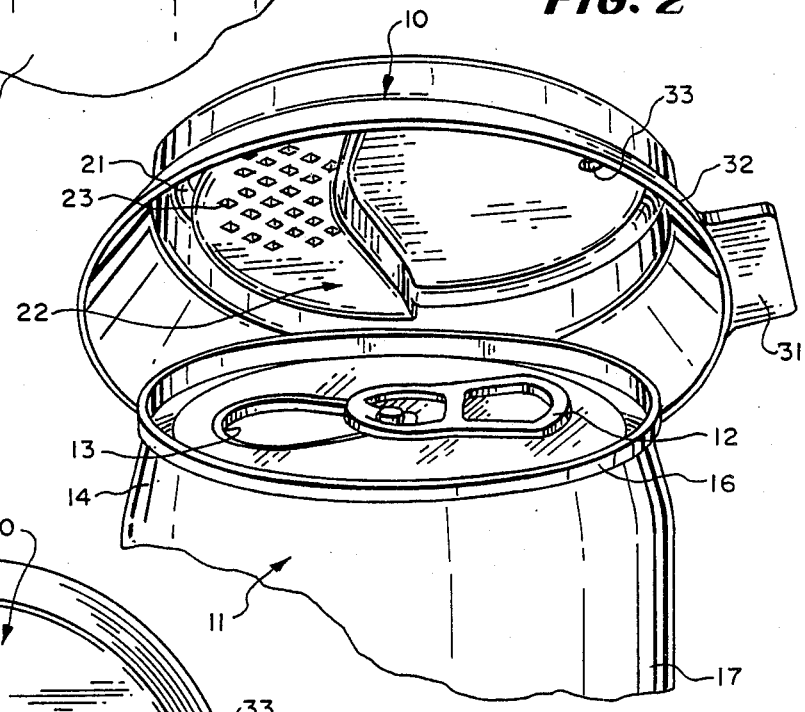
FIG. 2 is an exploded view similar to FIG. 1 showing the protective cover in an detached position relative to the beverage cans.
Figure 3:
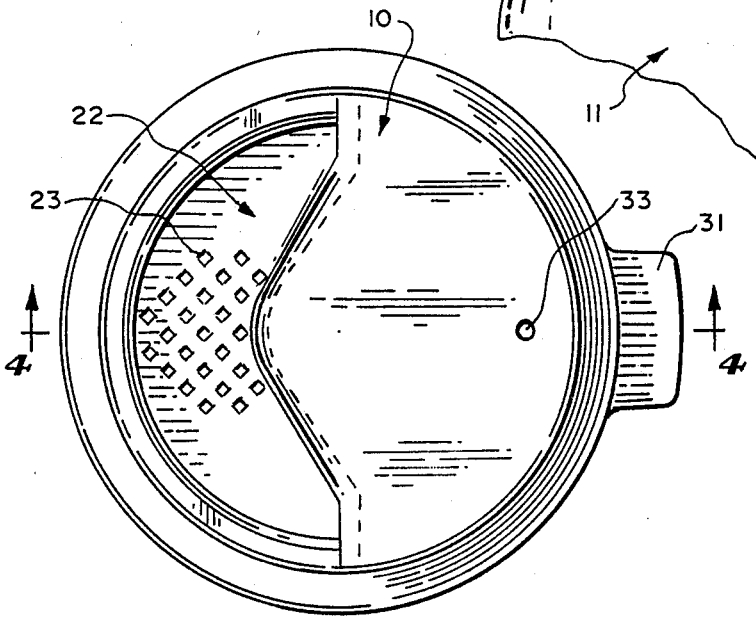
FIG. 3 is a top plan view of the beverage cover shown in FIG. 1.

It will further be seen that the cover 10 has an outer radially axially outwardly flaired margin 30 that generally matches the flair of the inwardly flaired upper neck 14 but is slightly spaced therefrom to facilitate assembly and removal of the cover from the can top. To further assist in the removal of the cover from the can top, the cover is provided with an radially outwardly extending U-shaped tab 31 at a lower edge of an radially outermost margin edge 32 of the cover as is clearly shown in FIGS. 1–3. This tab is integral with the cover 10 and is formed of the same material.

To also assist in the free flow of fluid from the beverage can 10 through the beverage can opening, the cover 10 is provided with a vent opening 33 that is provided between the depressed area 22 and the tab as is seen in FIGS. 1–4. To further assist in the free flow of fluid (FIG. 5) the depth of the depressed area 22 from the outer rim approximates the depth or can cover 15 from its raised circular edge 16 in a manner to provide a fluid flow control fit between the depressed area 22 and the can cover 15.

The cover 10 can be assembled with the can 11 by aligning the bead or rim 16 of the can with the groove 24 of the cover and causing the two to be progressively press fitted together with the softness of the plastic being yieldable to allow it to give where required in order to allow the rigid can rim 16 to be nested in the groove 24. It will be appreciated that excellent results can be obtained by manufacturing the cover 10 from a suitable synthetic plastic such as polyethylene or polypropylene. As stated before, the underneath surfaces of the cover 28 and 29 are spaced sufficiently from the spaced opposed surfaces of the cover flange 30 and the radially outer surface of the groove 24 so that the can rim 16 can be guided by the surfaces 28 and 29 into the groove 24. Now it will be appreciated that at the time that the cover 10 is to be mounted on the can, that the dished area 22 will be also prealigned with the opening 13 in the can top so that the beverage can flow through the opening in the can through the openings 23 and the depressed area 22 of the cover and into the mouth of the consumer.

When it is desired to remove the cover from the can, the consumer can manually grasp the tab 31 to lift the cover away from the rim or bead of the can. The cover can then be cleansed and reused, if desired. It also can be put into storage for future use. Thus, there is a certain economy with my cover 10 that has not been available with prior art devices of the same character and type. In this connection, the meshed area 22 having the openings 23 on the cover 11 serve to prevent bees and alike from entering the opening 13 in the can so that the chances for any insect to enter the can and to thereafter bite or injure the consumer is materially diminished.

It is thus seen, therefore, that there is provided an improved article in which the objects of the invention are achieved and which are well adapted to meet all conditions of practical use.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A protective one piece circular dish shaped synthetic plastic beverage can top cover for attachment only with closed top aluminum cans having an upstanding intergral loop-shaped radially outer rim for nested engagement with a raised circular can edge of a beverage can, the loop-shaped outer cover rim defining an axially inwardly opening annular groove for receiving a raised circular edge of the beverage can, when the cover is mounted upon an upper open end of a beverage can, the cover having a depressed area that has a meshed area positioned alignable with a can opening in an open upper end of a beverage can to allow beverage fluids to flow from a beverage can through the meshed area of the cover, the depth of said depressed area from said outer rim approximates the depth of a can cover from its raised circular edge in a manner to provide a fluid flow control fit between said depressed area and a can cover, the cover and the meshed area being cooperable with a loop-shaped outer cover rim when mounted upon a beverage can to prevent bees and the like from entering a can opening in top of a beverage can.

2. The protective cover of claim 1 further characterized by a U-shaped tab being mounted integrally with a radially outer end of the loop-shaped outer cover rim for being positioned exterially of the beverage can to enable the user to manually grasp the tab and pull the tab and the cover upwardly when the beverage can is resting on its bottom.

3. The protective cover of claim 1 further characterized by a U-shaped tab being mounted integrally with a radially outer end of the loop-shaped outer cover rim for being positioned exterially of the beverage can to enable the user to manually grasp the tab and pull the tab and the cover upwardly when the beverage can is resting on its bottom, the tab projecting radially outwardly generally at right angles to axial axis through a center of the cover.

4. The protective cover of claim 1 further characterized by the meshed area being comprised of a series of small holes each of which is 0.062" square.

5. The protective cover of claim 4 further characterized by the holes in the meshed area including being at least 25 in number.

6. The protective cover of claim 1 further characterized by a vent hole being located in the cover radially inwardly of the outer cover rim.

7. The protective cover of claim 1 further characterized by the depressed area being of an arched shape and with a remaining center area being raised relative to the depressed area to provide a downwardly opening cavity for receiving a can punch key.

8. In a beverage can assembly including a beverage can having a raised circular can edge, and a can key for punching a can opening in the cover, the improvement of a protective one piece circular dish shaped synthetic plastic beverage can top cover having an upstanding integral loop-shaped radially outer rim for nested engagement with a raised circular can edge of a beverage can, the loop-shaped outer cover rim defining an axially inwardly opening annular groove for receiving the raised circular edge of the beverage can when the cover is mounted upon an upper open end of a beverage can, the cover having a depressed area that has a meshed area alignable with the can opening in an open upper end of the beverage can to allow beverage fluids to flow from the beverage can through the meshed area of the cover, the depth of said depressed area from said outer rim approximates the depth of a can cover from its raised circular edge in a manner to provide a fluid flow control fit between said depressed area and a can cover, the cover and the meshed area being cooperable with the loop-shaped outer cover rim when mounted upon the beverage can to prevent bees and the like from entering the can opening in the top of the beverage can.

9. The assembly of claim 8 further characterized by a U-shaped tab being mounted integrally with a radially outer end of the loop-shaped outer cover rim for being positioned exterially of the beverage can to enable the user to manually grasp the tab and pull the tab and the cover upwardly when the beverage can is resting on its bottom.

10. The assembly of claim 8 further characterized by a U-shaped tab being mounted integrally with a radially outer end of the loop-shaped outer cover rim for being positioned exterially of the beverage can to enable the user to manually grasp the tab and pull the tab and the cover upwardly when the beverage can is resting on its bottom, the tab projecting radially outwardly generally at right angles to axial axis through a center of the cover.

11. The assembly of claim 8 further characterized by the meshed area being comprised of a series of small holes each of which is 0.062" square.

12. The assembly of claim 10 further characterized by the holes in the meshed area including being at least 25 in number.

13. The protective cover of claim 8 further characterized by a vent hole being located in the cover radially inwardly of the outer cover rim.

14. The protective cover of claim 8 further characterized by the depressed area being of an arched shape and with a remaining center area being of an arched shape and with a remaining center area being raised relative to the depressed area to provide a downwardly opening cavity for receiving a can punch key.

15. A protective one piece circular dish shaped synthetic plastic can top cover for attachment only with closed top aluminum cans and being sized for mounted press-on pull-off retained engagement with a top end of a beverage can and having an upstanding integral loop-shaped radially outer rim for nested engagement with a raised circular can edge of a beverage can, the loop-shaped outer cover rim defining an axially inwardly opening annular groove for receiving a raised circular edge of a beverage can when the cover is mounted upon an upper open end of a beverage can, the cover having a depressed area that has a meshed area lying in a plane beneath the radially outer cover rim for close disposition to a key hole opening in a depressed area of a top of a beverage can, the meshed area being alignable with a can opening at an open upper end of a beverage can to allow beverage fluids to flow from a beverage can through the meshed area of the cover, the depth of said depressed area from said outer rim approximates the depth of a can cover from its raised circular edge in a manner to provide a fluid flow control fit between said depressed area and a can cover, the cover and its meshed area being cooperable with the loop-shaped outer cover rim when mounted upon a beverage can to prevent bees and the like from entering the can opening in a top of a beverage can.

16. The cover of claim 15 further characterized by the loop-shaped radially outer rim and the depressed area sharing a common wall portion linking them together.

17. The cover of claim 16 further characterized by the common wall portion extending in a radially and axially inclined direction and thus enabling a radially outer surface of the common wall portion to act as a lead in to aid in guiding a rim of a beverage can to be guided into engaged relation in the axially inwardly opening groove.

18. The protective cover of claim 15 further characterized by the depressed area being of an arcuate shape defining a fluid cup for beverage and with a remaining center area being raised relative to the depressed area to provide a downwardly opening cavity for housing a can punch key when the cover is assembled with a beverage can.

19. The assembly of claim 15 further characterized by the meshed area being comprised of a series of small holes each of which is 0.062" square, and a vent hole being located in the cover radially inwardly of the outer cover rim.

20. The cover of claim 15 further characterized by the loop-shaped outer rim and the depressed area sharing a common wall portion linking them together, the common wall portion extending in a radially and axially inclined direction and thus enabling a radially outer surface of the common wall portion to act as a lead in to aid in guiding a rim of a beverage can to be guided into engaged relation in the axially inwardly opening groove, the depressed area being of an arcuate shape defining a fluid cup for beverage and with a remaining center area being raised relative to the depressed area to provide a downwardly opening cavity for housing a can punch key when the cover is assembled with a beverage can.

* * * * *